US011371757B2

(12) United States Patent
Sugiyama et al.

(10) Patent No.: US 11,371,757 B2
(45) Date of Patent: Jun. 28, 2022

(54) HEATING AND COOLING SYSTEM

(71) Applicant: E•T•L CORPORATION, Saitama (JP)

(72) Inventors: Naoki Sugiyama, Saitama (JP); Mitsuto Hisashige, Saitama (JP); Fumiharu Kurita, Saitama (JP); Tomoko Okamoto, Saitama (JP)

(73) Assignee: E.T.L CORPORATION, Saitama (JP)

( * ) Notice: Subject to any disclaimer, the term of this patent is extended or adjusted under 35 U.S.C. 154(b) by 0 days.

(21) Appl. No.: 16/978,975

(22) PCT Filed: Mar. 13, 2018

(86) PCT No.: PCT/JP2018/010671
§ 371 (c)(1),
(2) Date: Sep. 8, 2020

(87) PCT Pub. No.: WO2019/176122
PCT Pub. Date: Sep. 19, 2019

(65) Prior Publication Data
US 2021/0041150 A1 Feb. 11, 2021

(51) Int. Cl.
*F25B 40/00* (2006.01)
*F24F 1/32* (2011.01)

(52) U.S. Cl.
CPC ..... *F25B 40/00* (2013.01); *F24F 1/32* (2013.01)

(58) Field of Classification Search
CPC ..... F25B 40/00; F25B 40/02; F25B 40/04; F25B 40/06; F24F 1/26; F24F 1/32;
(Continued)

(56) References Cited

U.S. PATENT DOCUMENTS

2005/0011215 A1 1/2005 Gu
2008/0245098 A1* 10/2008 Yamanaka ..... F28D 7/14 62/513

(Continued)

FOREIGN PATENT DOCUMENTS

EP 1 930 669 A1 6/2008
JP S6073073 U 5/1985

(Continued)

OTHER PUBLICATIONS

Korean Office Action mailed by Korean Patent Office dated Jul. 19, 2021 in corresponding Koran patent application No. 10-2020-7024527.

(Continued)

*Primary Examiner* — Miguel A Diaz
(74) *Attorney, Agent, or Firm* — IP Business Solutions, LLC

(57) ABSTRACT

Provided is a highly efficient heating and cooling system. The heating and cooling system is provided with a cooling-purpose heat exchange section that, during cooling, subcools refrigerant, which is discharged from a compressor and liquefied by a heat source side heat exchanger, with an acceleration phenomenon of the refrigerant by rotating the refrigerant helically before the refrigerant reaches a pressure reducing device, and a heating-purpose heat exchange section that, during heating, partially vaporizes refrigerant, which is discharged from the compressor and liquefied by a use side heat exchanger, with an acceleration phenomenon of the refrigerant by rotating the refrigerant helically after the refrigerant has passed through the pressure reducing device and before the refrigerant reaches the heat source side heat exchanger, in which a heating-purpose coiled narrow tube of the heating-purpose heat exchange section has a flow passage that is formed to be wider than that of a cooling- (Continued)

purpose coiled narrow tube of the cooling-purpose heat exchange section.

6 Claims, 3 Drawing Sheets

(58) Field of Classification Search
CPC ..... F24F 1/0067; F24F 1/0007; F24F 1/0059; F24F 1/0325; F24F 1/18
See application file for complete search history.

(56) References Cited

U.S. PATENT DOCUMENTS

| | | | | |
|---|---|---|---|---|
| 2009/0241591 | A1 | 10/2009 | Hara et al. | |
| 2015/0204552 | A1* | 7/2015 | Kirkwold | F24F 6/043 261/158 |

FOREIGN PATENT DOCUMENTS

| | | | | |
|---|---|---|---|---|
| JP | H8-200890 | A | 8/1996 | |
| JP | 2000213822 | A | 8/2000 | |
| JP | 2005515395 | A | 5/2005 | |
| JP | 4411349 | B2 | 2/2010 | |
| JP | 4545824 | B1 | 9/2010 | |
| JP | 2010-281558 | A | 12/2010 | |
| JP | 2013122363 | A | 6/2013 | |
| KR | 10-0156386 | B | 2/1999 | |
| KR | 10-2004-0086294 | A | 10/2004 | |
| WO | 2007034939 | A1 | 3/2007 | |
| WO | 2010082483 | A1 | 7/2010 | |
| WO | WO-2010082483 | A1 * | 7/2010 | F25B 39/04 |
| WO | 2019155644 | A1 | 8/2019 | |

OTHER PUBLICATIONS

Written Opinion of the International Searching Authority of PCT Application No. PCT/JP2018/010671 dated Jun. 5, 2018.
International Search Report of PCT/JP2018/010671 dated Jun. 5, 2018.
Written Opinion of the International Searching Authority of PCT/JP2018/010671 dated Jun. 5, 2018.
Extended European Search Report mailed by European Patent Office dated Sep. 10, 2021 in corresponding European patent application No. 18 90 9684.5-1002.
Indian Office Action mailed by Indian Patent Office dated Feb. 12, 2021 in corresponding Indian patent application No. 202017038699.

* cited by examiner

HEATING AND COOLING SYSTEM

TECHNICAL FIELD

The present invention relates to a heating and cooling system in which energy efficiency is improved by using a coiled narrow tube and a coiled wide tube.

BACKGROUND ART

Conventionally, there is known a heating and cooling system that enables heating and cooling by connecting a heat source side unit provided with a compressor, a four-way valve, and a heat source side heat exchanger, and a use side unit provided with a use side heat exchanger in a loop configuration by inter-unit piping.

For this type of system, a proposal has been made to improve energy efficiency by connecting two coils in series to the inter-unit piping (for example, see Patent Literature 1).

CITATION LIST

Patent Literature

Patent Literature 1
Japanese Patent Laid-Open 2013-122363

SUMMARY OF INVENTION

Technical Problem

However, the prior art described above can only improve energy efficiency during cooling, and energy efficiency during heating has not been sufficiently improved.

Accordingly, an object of an aspect of the present invention is to solve the above-described problem of the prior art and to provide a highly efficient heating and cooling system.

Solution to Problem

An aspect of the present invention is a heating and cooling system having a heat source side unit provided with a compressor and a heat source side heat exchanger, and a use side unit provided with a use side heat exchanger, including a cooling-purpose heat exchange section that, during cooling, subcools refrigerant, which is discharged from the compressor and liquefied by the heat source side heat exchanger, with an acceleration phenomenon of the refrigerant by rotating the refrigerant helically before the refrigerant reaches a pressure reducing device, and a heating-purpose heat exchange section that, during heating, partially vaporizes refrigerant, which is discharged from the compressor and liquefied by the use side heat exchanger, with an acceleration phenomenon of the refrigerant by rotating the refrigerant helically after the refrigerant has passed through the pressure reducing device and before the refrigerant reaches the heat source side heat exchanger, in which a heating-purpose coiled narrow tube of the heating-purpose heat exchange section has a flow passage that is formed to be wider than that of a cooling-purpose coiled narrow tube of the cooling-purpose heat exchange section.

In the aspect of the present invention, the cooling-purpose heat exchange section may be provided with a cooling-purpose coiled wide tube that subcools the refrigerant, which is before reaching the cooling-purpose coiled narrow tube, with an acceleration phenomenon of the refrigerant by rotating the refrigerant helically.

In the aspect of the present invention, the heating-purpose heat exchange section may be provided with a heating-purpose coiled wide tube that partially vaporizes the refrigerant, which has passed through the heating-purpose coiled narrow tube, with an acceleration phenomenon of the refrigerant by rotating the refrigerant helically.

In the aspect of the present invention, during cooling, the refrigerant discharged from the compressor is liquefied by the heat source side heat exchanger and flows into the cooling-purpose heat exchange section. The cooling-purpose heat exchange section is configured, for example, by connecting two coils in series, each having a refrigerant flow passage in a spiral form. In each of the two flow passages, the refrigerant undergoes a spin rotation and flows at an increased flow rate, which causes the refrigerant to be subcooled.

Various verification tests were performed, and as a result, it was found out that the refrigerant is subcooled by being spin-rotated and accelerated in the process of flowing through the cooling-purpose heat exchange section of the present configuration.

That is, it was found out that the refrigerant that has passed through the cooling-purpose heat exchange section is substantially completely liquefied as compared with refrigerant that flows through a liquid pipe in a conventional cycle that does not include the cooling-purpose heat exchange section. The substantially completely liquefied refrigerant is decompressed by the pressure reducing device and flows into the use side heat exchanger. In the aspect of the present invention, energy efficiency is remarkably improved as compared with that in the prior art by the amount of decompression that is achieved when the refrigerant is subcooled and substantially completely liquefied. For example, energy savings of 16% were able to be achieved as compared with the conventional technique.

In the aspect of the present invention, during heating, the refrigerant discharged from the compressor is liquefied by the use side heat exchanger, is decompressed by the pressure reducing device, and flows into the heating-purpose heat exchange section.

The heating-purpose heat exchange section is configured, for example, by connecting two coils in series, each having a refrigerant flow passage in a spiral form. In each of the two flow passages, the refrigerant undergoes a spin rotation and flows at an increased flow rate. At this time, the refrigerant is partially vaporized. Since the heating-purpose coiled narrow tube has the flow passage that is formed to be wider than that of the cooling-purpose coiled narrow tube, the temperature drop inside the heating-purpose coiled narrow tube is suppressed, and thus the refrigerant flows into the heat source side heat exchanger while maintaining a relatively high temperature. Accordingly, the temperature of the refrigerant at an exit of the heat source side heat exchanger is relatively high, and as the refrigerant is drawn into the compressor in this state, energy efficiency is improved.

In the aspect of the present invention, a flow rate of the cooling-purpose heat exchange section may be set to be twice or more a flow rate of the heat source side heat exchanger, and a flow rate of the heating-purpose heat exchange section may be set to be twice or more a flow rate of the use side heat exchanger.

In the aspect of the present invention, the cooling-purpose heat exchange section and the heating-purpose heat exchange section may be each configured by winding, in a coiled shape, a pipeline having an inner diameter that is set according to a discharge capacity of the compressor.

In the aspect of the present invention, a heat exchange unit that integrally accommodates the cooling-purpose heat exchange section and the heating-purpose heat exchange section may be provided.

Advantageous Effect of Invention

In the heating and cooling system of an aspect of the present invention, an efficient operation can be performed both during cooling and during heating.

DESCRIPTION OF EMBODIMENTS

Hereinafter, an embodiment of the present invention will be described with reference to the accompanying drawings.

Figure 1:
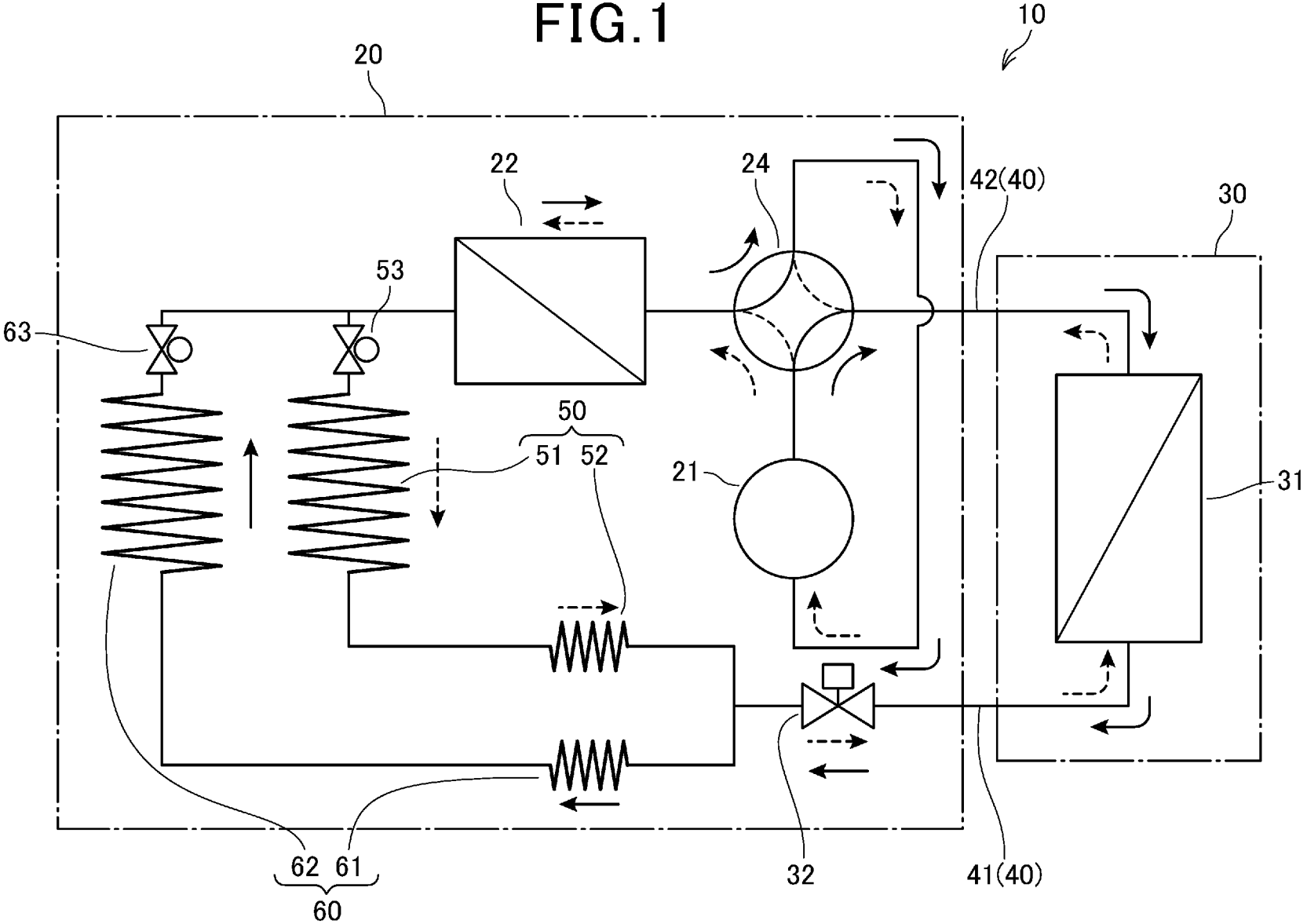
FIG. 1 is a circuit structure diagram showing an embodiment of the present invention.

In FIG. 1, 10 denotes a heating and cooling system. The heating and cooling system 10 includes a heat source side unit 20 and a use side unit 30, and the units 20 and 30 are connected to each other by inter-unit piping 40 that circulates refrigerant.

The heat source side unit 20 includes a compressor 21, a four-way valve 24, and a heat source side heat exchanger 22, and these devices 21, 22, and 24 and piping that connects the devices 21, 22, and 24 to each other are disposed in the unit 20. The use side unit 30 includes a use side heat exchanger 31, and the device 31 and piping are disposed in the unit 30.

In the present embodiment, the heat source side unit 20 is disposed outdoors, and the use side unit 30 is disposed on the upper part of a wall (or ceiling) of a building. These units 20 and 30 are connected to each other by the inter-unit piping 40, and the inter-unit piping 40 is provided with a liquid pipe 41 and a gas pipe 42. In the liquid pipe 41, a cooling-purpose heat exchange section 50 and a heating-purpose heat exchange section 60 are connected in parallel in a pipeline located between the heat source side heat exchanger 22 and a pressure reducing device 32.

During cooling operation, the refrigerant flows through the cooling-purpose heat exchange section 50. The cooling-purpose heat exchange section 50 includes a cooling-purpose coiled wide tube 51 that, during cooling, cools the refrigerant, which is discharged from the compressor 21 and liquefied by the heat source side heat exchanger 22, with an acceleration phenomenon of the refrigerant before the refrigerant reaches the pressure reducing device 32, and a cooling-purpose coiled narrow tube 52 that subcools the refrigerant, which has passed through the cooling-purpose coiled wide tube 51, with an acceleration phenomenon of the refrigerant. 53 is an on-off valve.

The cooling-purpose heat exchange section 50 has a function of subcooling the refrigerant by applying a spin rotation to the refrigerant so as to increase the flow rate of the refrigerant.

Therefore, the cooling-purpose heat exchange section 50 may have any configuration having a refrigerant flow passage in a spiral form if it is configured to be able to apply a spin rotation to the refrigerant so as to increase the flow rate of the refrigerant. For example, the cooling-purpose heat exchange section 50 may be a block-like structure having a refrigerant flow passage in a spiral form therein.

During heating operation, the refrigerant flows through the heating-purpose heat exchange section 60. The heating-purpose heat exchange section 60 includes a heating-purpose coiled narrow tube 61 that, during heating, partially vaporizes the refrigerant, which is discharged from the compressor 21 and liquefied by the use side heat exchanger 31, with an acceleration phenomenon of the refrigerant after the refrigerant has passed through the pressure reducing device 32 and before the refrigerant reaches the heat source side heat exchanger 22, and a heating-purpose coiled wide tube 62 that partially vaporizes the refrigerant, which has passed through the heating-purpose coiled narrow tube 61, with an acceleration phenomenon of the refrigerant. 63 is an on-off valve.

The heating-purpose heat exchange section 60 has a function of partially evaporating the refrigerant by applying a spin rotation to the refrigerant so as to increase the flow rate of the refrigerant.

Therefore, the heating-purpose heat exchange section 60 may have any configuration having a refrigerant flow passage in a spiral form if it is configured to be able to apply a spin rotation to the refrigerant so as to increase the flow rate of the refrigerant. For example, the heating-purpose heat exchange section 60 may be a block-like structure having a refrigerant flow passage in a spiral form therein.

The cooling-purpose coiled wide tube 51 and the heating-purpose coiled wide tube 62 are each formed by winding a wide tube into a coil, and their flow passage areas and lengths are set to be equal. While the inner diameters and the numbers of windings thereof are determined based on various specifications such as a discharge capacity of the compressor 21 and a refrigerating capacity of the heating and cooling system, their acceptable inner diameters are from 2 to 150 mm and their desirable inner diameters are from 2 to 50 mm.

In the present embodiment, the cooling-purpose coiled wide tube 51 and the heating-purpose coiled wide tube 62 are provided separately, but these wide tubes may be communalized to be a single coiled wide tube. In this case, both during cooling and during heating, the refrigerant flows through the single coiled wide tube. When the single coiled wide tube is used, the structure of a refrigerant circuit can be simplified.

The cooling-purpose coiled narrow tube 52 and the heating-purpose coiled narrow tube 61 are each formed by winding a narrow tube into a coil, and their lengths are set to be equal.

While the inner diameters and the numbers of windings thereof are determined based on various specifications such as a discharge capacity of the compressor 21 and a refrigerating capacity of the heating and cooling system, the inner diameters of the coiled narrow tubes 52 and 61 are set to be narrower than the inner diameters of the coiled wide tubes 51 and 62. For example, when a throttle diameter of the pressure reducing device 32 is about 1 mm, the inner diameter of the cooling-purpose coiled narrow tube 52 is desirably 8 to 12 mm, and the inner diameter of the heating-purpose coiled narrow tube 61 is desirably 15 to 33 mm.

In the present embodiment, the inner diameter of the heating-purpose coiled narrow tube 61 is set to be larger than the inner diameter of the cooling-purpose coiled narrow tube 52.

While the inner diameters and the numbers of windings thereof are determined based on various specifications such as a discharge capacity of the compressor 21 and a refrigerating capacity of the heating and cooling system, the inner diameter of the heating-purpose coiled narrow tube 61 is 15 to 33 mm when the inner diameter of the cooling-purpose coiled narrow tube 52 is set to be 8 to 12 mm, for example.

In the present embodiment, the number of the cooling-purpose coiled narrow tube 52 and the heating-purpose coiled narrow tube 61 is one for each, but the coiled narrow tubes 52 and 61 may be each formed by connecting two coiled tubes in parallel. Furthermore, they may be formed by connecting 3 or more coiled tubes in parallel.

The coiled narrow tubes 52 and 61 may be each formed by connecting, in series, two coiled tubes having winding directions opposite to each other, or may be formed by connecting such coils further in parallel. A cross-sectional area of a portion through which the refrigerant passes of each of the coiled narrow tubes 52 and 61 (a total of cross-sectional areas of a plurality of tubes when the plurality of tubes are connected in parallel) is smaller than a cross-sectional area of each of the coiled wide tubes 51 and 62.

Next, an operation of the present embodiment will be described.

<During Cooling>

During cooling, the four-way valve 24 is switched to a cooling position indicated by broken lines, the on-off valve 63 is closed, and the on-off valve 53 is opened. When the compressor 21 is driven, the refrigerant flows in the order of the four-way valve 24, the heat source side heat exchanger 22, and the cooling-purpose heat exchange section 50 in which the two coils are connected in series, as indicated by dashed arrows, and the refrigerant returns to the compressor 21 after passing through the use side heat exchanger 31.

During cooling, a high-temperature (40° C. or higher) and high-pressure (0.6 MPa or higher) gaseous refrigerant is discharged from the compressor 21, and the refrigerant reaches the heat source side heat exchanger 22 where it is liquefied. The refrigerant liquefied in the heat source side heat exchanger 22 enters the cooling-purpose coiled wide tube 51 because the on-off valve 63 of the heating-purpose heat exchange section 60 is closed and the on-off valve 53 of the cooling-purpose heat exchange section 50 is opened. In terms of a cross-sectional area of the refrigerant flow passage, the cross-sectional area of the cooling-purpose coiled wide tube 51 is smaller than that of the heat source side heat exchanger 22 with respect to the heat source side heat exchanger 22.

When the refrigerant enters the cooling-purpose coiled wide tube 51 of the cooling-purpose heat exchange section 50, the refrigerant is accelerated due to a suction action and the like of the compressor 21 (which is referred to as an acceleration phenomenon of the refrigerant), which is accompanied by decompression and enthalpy reduction that makes the refrigerant substantially liquefied with an increased amount of liquid.

On an exit side of the cooling-purpose coiled wide tube 51, an intermediate-pressure liquid refrigerant is obtained. Temperature in the cooling-purpose coiled wide tube 51 decreases mainly because enthalpy of the refrigerant, which is a thermal energy, is converted into a velocity energy in the cooling-purpose coiled wide tube 51, which causes a reduction of the enthalpy of the refrigerant, resulting in an occurrence of a phenomenon of a static temperature drop.

The flow rate in the cooling-purpose coiled wide tube 51 is desirably set to be twice or more the flow rate in the heat source side heat exchanger 22 in the design of the present heating and cooling system.

The refrigerant that has become an intermediate-pressure liquid refrigerant in the cooling-purpose coiled wide tube 51 enters the cooling-purpose coiled narrow tube 52. When the substantially liquefied refrigerant enters the cooling-purpose coiled narrow tube 52, the refrigerant is accelerated due to a suction action and the like of the compressor 21 (which is referred to as an acceleration phenomenon of the refrigerant), which is accompanied by decompression and enthalpy reduction that makes the liquefied refrigerant subcooled. On an exit side of the cooling-purpose coiled narrow tube 52, the refrigerant is decompressed and cooled to be a low-temperature liquid, and becomes a low-pressure liquid as the pressure is reduced.

Temperature in the cooling-purpose coiled narrow tube 52 also decreases mainly because, as in the case of the temperature drop in the cooling-purpose coiled wide tube 51, enthalpy of the refrigerant, which is a thermal energy, is converted into a velocity energy, which causes a reduction of the enthalpy of the refrigerant, resulting in an occurrence of a phenomenon of a static temperature drop. Desirably, the flow rate in the cooling-purpose coiled narrow tube 52 is twice or more the flow rate in the heat source side heat exchanger 22, and equal to or more the flow rate in the cooling-purpose coiled wide tube 51 in the design of the present heating and cooling system.

The refrigerant, which is subcooled by the cooling-purpose coiled narrow tube 52 and becomes a low-temperature liquid, reaches the pressure reducing device 32, where it is decompressed and sent to the use side heat exchanger 31. In the use side heat exchanger 31, the refrigerant vaporizes due to heat absorption under isobaric and isothermal expansion, thereby completing the cooling cycle.

In the present embodiment, during cooling, in each of the two coils 51 and 52, the refrigerant undergoes a spin rotation and flows at an increased flow rate, which causes the refrigerant to be subcooled.

Various verification tests were performed, and as a result, it was found out that the refrigerant is subcooled by being spin-rotated and accelerated in the process of flowing through the cooling-purpose heat exchange section 50 of the present configuration. That is, it was found out that the refrigerant that has passed through the cooling-purpose heat exchange section 50 is substantially completely liquefied as compared with refrigerant that flows through the liquid pipe 41 in a conventional cycle that does not include the cooling-purpose heat exchange section 50. The substantially completely liquefied refrigerant is decompressed by the pressure reducing device 32 and flows into the use side heat exchanger 31.

In the present embodiment, energy efficiency is remarkably improved as compared with that in the prior art by the amount of decompression that is achieved when the refrigerant is subcooled and substantially completely liquefied in the cooling-purpose heat exchange section 50. For example, energy savings of 16% were able to be achieved as compared with the conventional technique.

It is desirable that in the cooling-purpose heat exchange section 50, the diameter of the flow passage in a spiral form to be gradually narrower from the upstream toward the downstream. However, gradually reducing the diameter is difficult in terms of production technology. Therefore, in the present embodiment, two series coils 51 and 52 are employed in order to make the form easy to be produced in terms of production technology, and in this case, the diameter of the downstream coil 52 is configured to be narrower than that of the upstream coil 51.

In this configuration, the downstream coil 52 functions as a throttle, which generates a drawback that the refrigerant is decompressed. For example, when the downstream coil 52 has a 50% or less inner diameter than that of the upstream coil 51, the drawback due to excessive restriction becomes large. It is desirable that the inner diameter of the downstream coil 52 is 50% or more than the inner diameter of the upstream coil 51.

<During Heating>

During heating, the four-way valve 24 is switched to a heating position indicated by solid lines, the on-off valve 63 is opened, and the on-off valve 53 is closed. When the compressor 21 is driven, the refrigerant flows in the order of the four-way valve 24, the use side heat exchanger 31, the pressure reducing device 32, and the heating-purpose heat exchange section 60 in which the two coils are connected in series, as indicated by solid arrows, and the refrigerant returns to the compressor 21 after passing through the heat source side heat exchanger 22.

During heating, when a high-temperature (40° C. or higher) and high-pressure (0.6 MPa or higher) gaseous refrigerant is discharged from the compressor 21, the refrigerant is liquefied in the use side heat exchanger 31.

The refrigerant liquefied in the use side heat exchanger 31 enters the heating-purpose coiled narrow tube 61 through the pressure reducing device 32. In terms of a cross-sectional area of the refrigerant flow passage, the cross-sectional area of the heating-purpose coiled narrow tube 61 is smaller than that of the use side heat exchanger 31 with respect to the use side heat exchanger 31.

When the refrigerant enters the heating-purpose coiled narrow tube 61, the refrigerant is accelerated due to a suction action and the like of the compressor 21 (which is referred to as an acceleration phenomenon of the refrigerant), which is accompanied by decompression and enthalpy reduction that makes the refrigerant partially vaporized.

When this occurs, since the inner diameter of the heating-purpose coiled narrow tube 61 is set to be larger than the inner diameter of the cooling-purpose coiled narrow tube 52, the refrigerant is partially vaporized while the temperature is not reduced so much as compared with the case in which the inner diameter of the heating-purpose coiled narrow tube 61 and the inner diameter of the cooling-purpose coiled narrow tube 52 are set to be equal.

On an exit side of the heating-purpose coiled narrow tube 61, a partially vaporized intermediate-pressure refrigerant is obtained. Temperature in the heating-purpose coiled narrow tube 61 decreases mainly because enthalpy of the refrigerant, which is a thermal energy, is converted into a velocity energy in the heating-purpose coiled narrow tube 61, which causes a reduction of the enthalpy of the refrigerant, resulting in an occurrence of a phenomenon of a static temperature drop.

The flow rate in the heating-purpose coiled narrow tube 61 is desirably set to be twice or more the flow rate in the use side heat exchanger 31 in the design of the present heating and cooling system.

The refrigerant that has partially vaporized in the heating-purpose coiled narrow tube 61 enters the heating-purpose coiled wide tube 62. When the partially vaporized refrigerant enters the heating-purpose coiled wide tube 62, the refrigerant is accelerated due to a suction action and the like of the compressor 21 (which is referred to as an acceleration phenomenon of the refrigerant), which is accompanied by decompression and enthalpy reduction that makes the refrigerant partially vaporized. On an exit side of the heating-purpose coiled wide tube 62, the pressure of the refrigerant is reduced to be a low-pressure gas refrigerant.

Temperature in the heating-purpose coiled wide tube 62 also decreases mainly because, as in the case of the temperature drop in the heating-purpose coiled narrow tube 61, enthalpy of the refrigerant, which is a thermal energy, is converted into a velocity energy, which causes a reduction of the enthalpy, resulting in an occurrence of a phenomenon of a static temperature drop.

The gas refrigerant, whose temperature has been reduced by the heating-purpose coiled wide tube 62, is sent to the heat source side heat exchanger 22. In the heat source side heat exchanger 22, the refrigerant vaporizes due to heat absorption under isobaric and isothermal expansion, thereby completing the heating cycle.

In the present embodiment, the inner diameter of the heating-purpose coiled narrow tube 61 is formed to be wider than the inner diameter of the cooling-purpose coiled narrow tube 52 serving as a reference.

When the heat exchange sections 50 and 60 are provided in parallel, first, the inner diameter of the cooling-purpose coiled narrow tube 52 is determined on the basis of the degree of subcooling during cooling operation. Then, the inner diameter of the heating-purpose coiled narrow tube 61 is formed to be wider than the above-defined inner diameter of the cooling-purpose coiled narrow tube 52 serving as a reference.

In the conventional heating and cooling system (for example, see Patent Literature 1), since the inner diameter of the heating-purpose coiled narrow tube 61 and the inner diameter of the cooling-purpose coiled narrow tube 52 are set to be equal, an efficient operation can be performed during cooling, but there is a problem that the temperature of the refrigerant becomes too low when the pressure is reduced in the heating-purpose coiled narrow tube 61 during heating. This is because the heating and cooling system is designed in consideration of the degree of subcooling during cooling.

In the present embodiment, during heating, the refrigerant undergoes a spin rotation and flows at an increased flow rate in each of the two coils 61 and 62. At this time, the refrigerant is partially vaporized in the coils 61 and 62.

In this regard, since the heating-purpose coiled narrow tube 61 has a flow passage that is formed wider than that of the cooling-purpose coiled narrow tube 52, the temperature drop inside the heating-purpose coiled narrow tube 61 is suppressed, and thus the refrigerant flows into the heat source side heat exchanger 22 while maintaining a relatively high temperature. Accordingly, the temperature of the refrigerant at an exit of the heat source side heat exchanger 22 is relatively high, and as the refrigerant is drawn into the compressor 21 in this state, energy efficiency during heating operation is improved.

Figure 2:
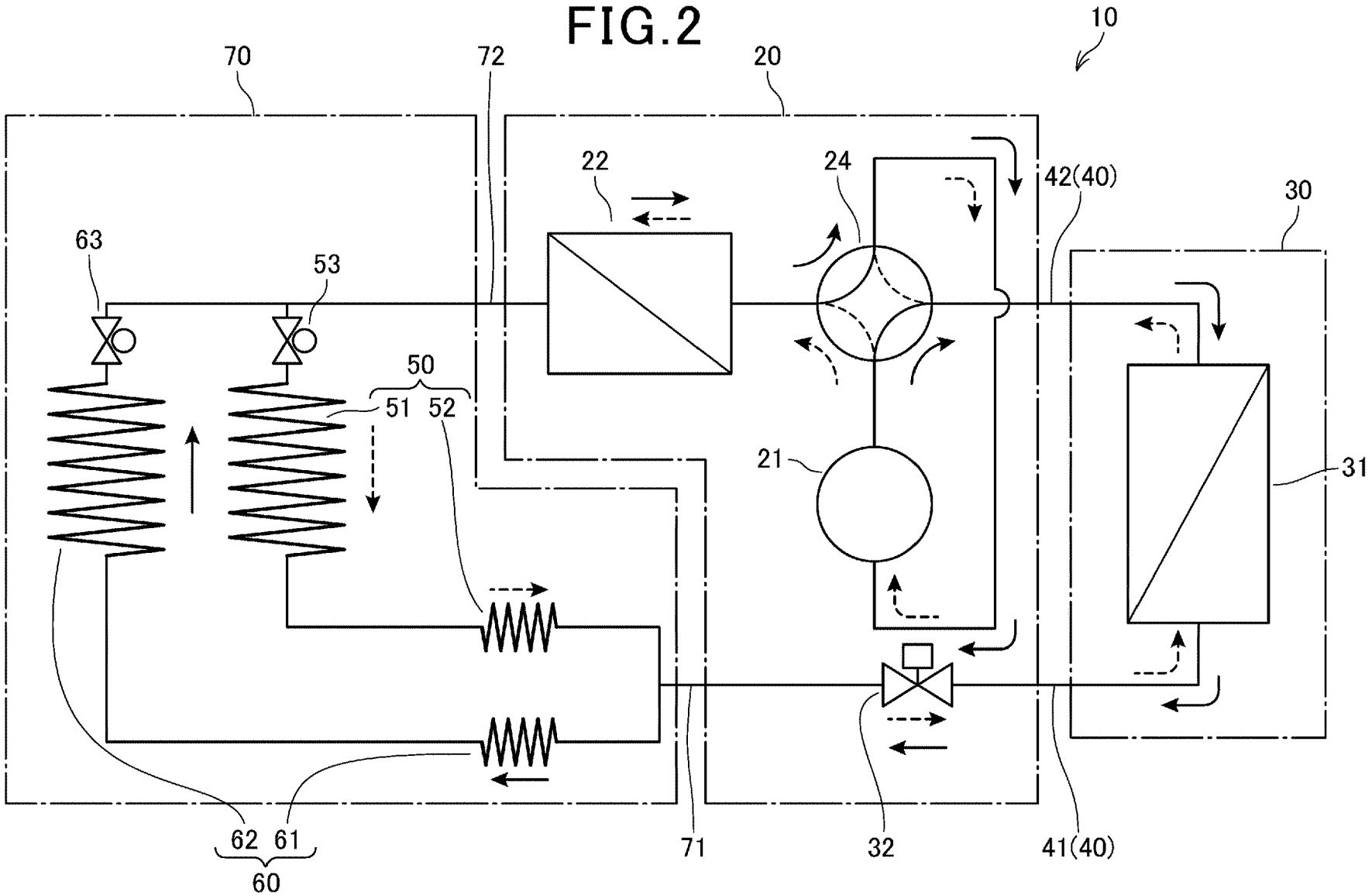
FIG. 2 is a circuit structure diagram showing another embodiment of the present invention.

FIG. 2 shows another embodiment. In FIG. 2, portions configured in the same manner as in FIG. 1 will be denoted by the same reference signs, and the descriptions thereof will be omitted.

In the present embodiment, the heating and cooling system 10 is divided into the heat source side unit 20, the use side unit 30, and a heat exchange unit 70. In the heat exchange unit 70, the cooling-purpose heat exchange section 50 and the heating-purpose heat exchange section 60 are integrally accommodated.

Then, the heat source side unit 20 and the use side unit 30 are connected by the inter-unit piping 40 described above, and the heat source side unit 20 and the heat exchange unit 70 are connected to each other by connecting piping 71 and 72.

In the present embodiment, when a conventional heating and cooling system including the heat source side unit 20 and the use side unit 30 is already installed, for example, the main heating and cooling system 10 can be easily constructed by retrofit work.

The retrofit work may be performed by cutting piping between the heat source side heat exchanger 22 and the pressure reducing device 32 in the conventional heating and cooling system, preparing newly the heat exchange unit 70, and connecting the heat source side unit 20 and the heat exchange unit 70 to each other by the connecting piping 71 and 72. This retrofit work can be performed extremely easily.

In the present embodiment, the cooling-purpose heat exchange section 50 and the heating-purpose heat exchange section 60 are integrally accommodated in the heat exchange unit 70, but the present invention is not limited thereto, and the cooling-purpose heat exchange section 50 and the heating-purpose heat exchange section 60 may be disposed outside of the heat source side unit 20 in a state of being exposed outside without being accommodated in the heat exchange unit 70.

In the embodiment of FIG. 1, the cooling-purpose heat exchange section 50 is configured with the two coils 51 and 52, and the heating-purpose heat exchange section 60 is configured with the two coils 61 and 62, but the present invention is not limited thereto.

Figure 3:
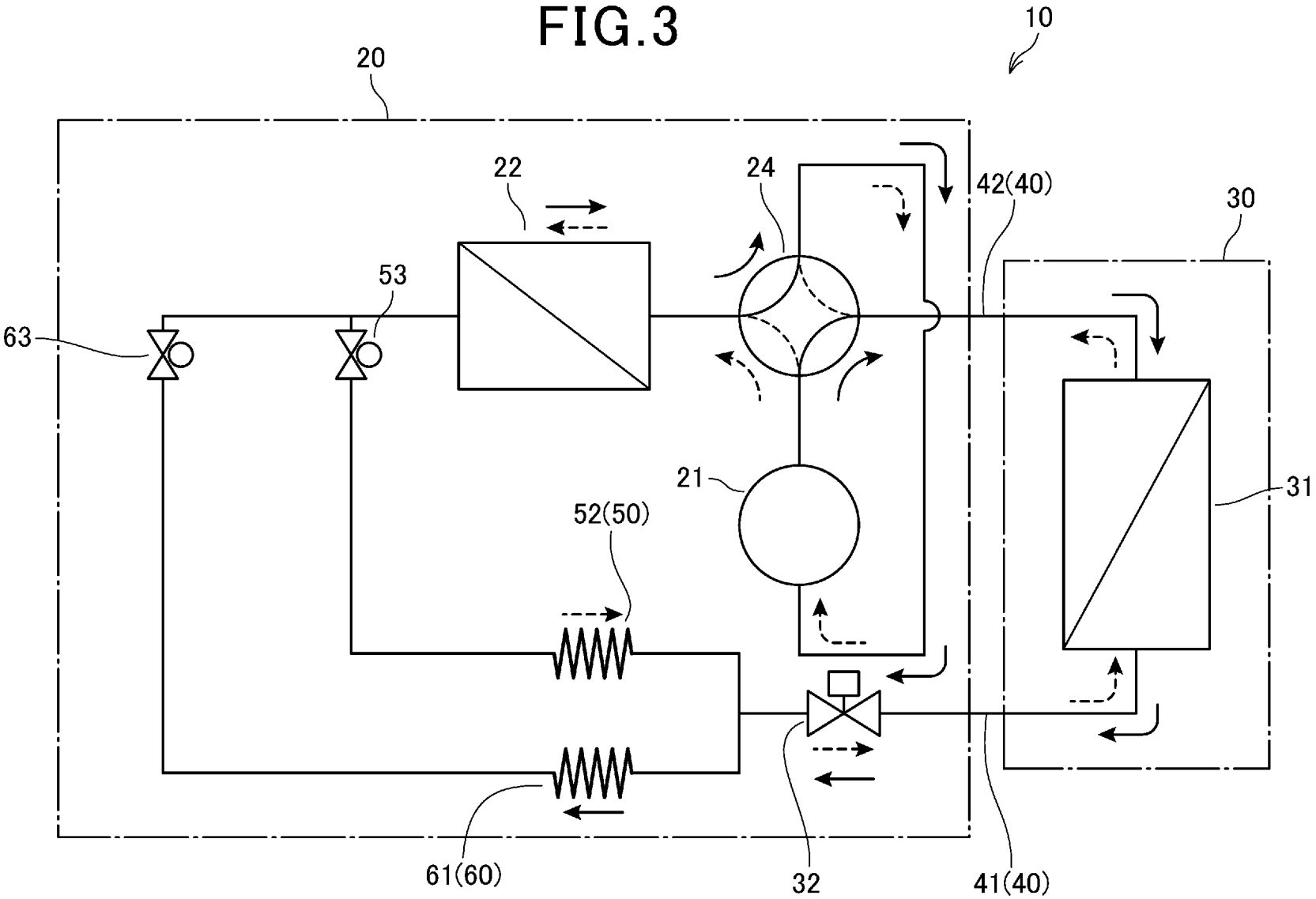
FIG. 3 is a circuit structure diagram showing yet another embodiment of the present invention.

FIG. 3 shows yet another embodiment. In FIG. 3, portions configured in the same manner as in FIG. 1 will be denoted by the same reference signs, and the descriptions thereof will be omitted.

In the present embodiment, the cooling-purpose heat exchange section 50 is configured with a single cooling-purpose coiled narrow tube 52. Furthermore, the heating-purpose heat exchange section 60 is configured with a single heating-purpose coiled narrow tube 61. Then, the inner diameter of the heating-purpose coiled narrow tube 61 is formed to be wider than the inner diameter of the cooling-purpose coiled narrow tube 52. For example, the inner diameter of the coiled narrow tube 52 is desirably 8 to 12 mm, and when the inner diameter of the cooling-purpose coiled narrow tube 52 is set to be 8 to 12 mm, the inner diameter of the heating-purpose coiled narrow tube 61 is 15 to 33 mm.

In the present embodiment, during cooling, when the refrigerant enters the cooling-purpose coiled narrow tube 52, the refrigerant is accelerated due to a suction action and the like of the compressor 21 (which is referred to as an acceleration phenomenon of the refrigerant), which is accompanied by decompression and enthalpy reduction that makes the liquified refrigerant subcooled. On an exit side of the cooling-purpose coiled narrow tube 52, the refrigerant is decompressed and cooled to be a low-temperature liquid, and becomes a low-pressure liquid as the pressure is reduced. Accordingly, energy efficiency during cooling operation is improved.

Furthermore, during heating, when the refrigerant enters the heating-purpose coiled narrow tube 61, the refrigerant is accelerated due to a suction action and the like of the compressor 21 (which is referred to as an acceleration phenomenon of the refrigerant), which is accompanied by decompression and enthalpy reduction that makes the refrigerant partially vaporized. When this occurs, since the inner diameter of the heating-purpose coiled narrow tube 61 is set to be larger than the inner diameter of the cooling-purpose coiled narrow tube 52, the refrigerant is partially vaporized while the temperature is not reduced so much as compared with the case in which the inner diameter of the heating-purpose coiled narrow tube 61 and the inner diameter of the cooling-purpose coiled narrow tube 52 are set to be equal.

Therefore, since the temperature of the gas refrigerant returning to the compressor 21 is relatively high, efficiency of a heating cycle is improved.

In the present embodiment, since efficiency not only during cooling but also during heating is ensured, an efficient operation can be performed both during heating and cooling.

It should be noted that though illustration is omitted, it is obvious that even in this other embodiment, as shown in FIG. 2, the retrofit work can be established.

As described above, although the present invention has been demonstrated based on one embodiment, the present invention is not limited thereto, and various modifications can be implemented. The present invention can be applied to any heating and cooling system such as an air conditioner, a cooling device, and a refrigerator for home use.

REFERENCE SIGNS LIST

10 Heating and cooling system
20 Heat source side unit
30 Use side unit
40 Inter-unit piping
21 Compressor
24 Four-way valve
22 Heat source side heat exchanger
31 Use side heat exchanger
41 Liquid pipe
50 Cooling-purpose heat exchange section
60 Heating-purpose heat exchange section
51 Cooling-purpose coiled wide tube
52 Cooling-purpose coiled narrow tube
61 Heating-purpose coiled narrow tube
62 Heating-purpose coiled wide tube

The invention claimed is:

1. A heating and cooling system comprising:
a heat source side unit provided with a compressor;
a heat source side heat exchanger; and
a use side unit provided with a use side heat exchanger, wherein
the heat source side unit includes a four-way valve,
the heating and cooling system further comprises:
an expansion valve that decompresses refrigerant,
a cooling-purpose heat exchange section that, during cooling in which the four-way valve is switched to a cooling position, subcools the refrigerant, which is discharged from the compressor and liquefied by the heat source side heat exchanger, with an acceleration phenomenon of the refrigerant by rotating the refrigerant helically before the refrigerant reaches the expansion valve, and
a heating-purpose heat exchange section that, during heating in which the four-way valve is switched to a heating position, partially vaporizes refrigerant, which is discharged from the compressor and liquefied by the use side heat exchanger, with an acceleration phenomenon of the refrigerant by rotating the refrigerant helically after the refrigerant has passed through the expansion valve and before the refrigerant reaches the heat source side heat exchanger, the cooling-purpose heat exchange section and the heating-purpose heat exchange section are connected in parallel in a pipeline located between the heat source side heat exchanger and the expansion valve, a first on-off valve that is opened during cooling and that is closed during heating is provided between the heat source side heat exchanger and the cooling-purpose heat exchange section, a second on-off valve that is closed during cooling and that is opened during heating is provided between the heat source side heat exchanger and the heating-purpose heat exchange section, a heating-purpose coiled narrow tube of the heating-purpose heat exchange section has a flow passage that is formed to be wider than that of a cooling-purpose coiled narrow tube of the cooling-purpose heat exchange section.

2. The heating and cooling system according to claim 1, wherein, the cooling-purpose heat exchange section is provided with a cooling-purpose coiled wide tube that subcools the refrigerant, which is before reaching the cooling-purpose coiled narrow tube, with an acceleration phenomenon of the refrigerant by rotating the refrigerant helically.

3. The heating and cooling system according to claim 1, wherein the heating-purpose heat exchange section is provided with a heating-purpose coiled wide tube that partially vaporizes the refrigerant, which has passed through the heating-purpose coiled narrow tube, with an acceleration phenomenon of the refrigerant by rotating the refrigerant helically.

4. The heating and cooling system according to claim 1, wherein a flow rate of the cooling-purpose heat exchange section is set to be twice or more a flow rate of the heat source side heat exchanger, and a flow rate of the heating-purpose heat exchange section is set to be twice or more a flow rate of the use side heat exchanger.

5. The heating and cooling system according to claim 1, wherein the cooling-purpose heat exchange section and the heating-purpose heat exchange section are each configured by winding, in a coiled shape, a pipeline having an inner diameter that is set according to a discharge capacity of the compressor.

6. The heating and cooling system according to claim 1, wherein a heat exchange unit that integrally accommodates the cooling-purpose heat exchange section and the heating-purpose heat exchange section is provided.

* * * * *